US011583022B2

(12) United States Patent
Rovegno

(10) Patent No.: US 11,583,022 B2
(45) Date of Patent: Feb. 21, 2023

(54) APPARATUS AND METHOD FOR PROTECTING COSMETIC ENHANCEMENTS

(71) Applicant: Noelle Marie Rovegno, Gaithersburg, MD (US)

(72) Inventor: Noelle Marie Rovegno, Gaithersburg, MD (US)

( * ) Notice: Subject to any disclaimer, the term of this patent is extended or adjusted under 35 U.S.C. 154(b) by 41 days.

(21) Appl. No.: 16/645,053

(22) PCT Filed: Oct. 10, 2019

(86) PCT No.: PCT/US2019/055550

§ 371 (c)(1),
(2) Date: Mar. 6, 2020

(87) PCT Pub. No.: WO2020/106377

PCT Pub. Date: May 28, 2020

(65) Prior Publication Data

US 2021/0106087 A1 Apr. 15, 2021

Related U.S. Application Data

(60) Provisional application No. 62/769,248, filed on Nov. 19, 2018.

(51) Int. Cl.
*A42B 1/0182* (2021.01)
*A42B 1/006* (2021.01)
(Continued)

(52) U.S. Cl.
CPC ..... *A42B 1/0182* (2021.01); *A42B 1/006* (2013.01); *A45D 8/36* (2013.01); *A45D 44/12* (2013.01)

(58) Field of Classification Search
CPC ..... A42B 1/0182; A42B 1/208; A42B 1/006; A41D 13/1184; A41D 20/00; A45D 8/36; A45D 44/12; A45D 44/00
(Continued)

(56) References Cited

U.S. PATENT DOCUMENTS 452,155 A * 5/1891 Ahlstrom ..... A41D 13/11 2/206
2,032,898 A * 3/1936 Wilson ..... A45D 44/12 4/521
(Continued)

FOREIGN PATENT DOCUMENTS

FR 973014 A 2/1951
KR 200483618 Y1 6/2017

*Primary Examiner* — Jocelyn Bravo
(74) *Attorney, Agent, or Firm* — Hutchison Law, LLC; Linda S. Hutchison, Esq.

(57) ABSTRACT

An apparatus for protecting cosmetic enhancements, such as false eyelashes, eyelash extensions, or enhanced eyebrows from water, such as shower water, is disclosed. The protective apparatus may comprise a headband, a visor, and left and right ear pieces. The protective apparatus may be worn above a wearer's eyebrow lines and may adjust to create a water impervious seal with a wearer's forehead or face. A structure comprising a combination of the headband and left and right ear pieces' may create the water impervious seal between the protective apparatus and the wearer's face or forehead. The structure may comprise a planar stretchable material, left and right ear pieces, and ear piece adjustment mechanisms. A combination of all or any of the above-listed elements may support deflecting water from the cosmetic enhancements. The water impervious seal may minimize water seepage to the wearer's cosmetic enhancements.

2 Claims, 6 Drawing Sheets

(51) Int. Cl.
*A45D 44/12* (2006.01)
*A45D 8/36* (2006.01)

(58) Field of Classification Search
USPC ..... 2/174
See application file for complete search history.

(56) References Cited

U.S. PATENT DOCUMENTS

| | | | | | |
|---|---|---|---|---|---|
| 2,081,088 | A * | 5/1937 | Guntrup | G09F 1/06 | 2/9 |
| 2,265,529 | A * | 12/1941 | Kemp | A41D 13/1161 | 128/863 |
| 2,696,008 | A * | 12/1954 | Penman | A45D 44/12 | 4/521 |
| 3,310,812 | A * | 3/1967 | Gaisser | A61F 9/027 | 2/9 |
| 4,223,407 | A * | 9/1980 | Zappala | A45D 44/12 | 2/174 |
| 4,481,680 | A * | 11/1984 | Mason | A45D 44/12 | 2/171.2 |
| 5,857,218 | A * | 1/1999 | Kuhlman | A45D 44/10 | 2/174 |
| 2002/0138894 | A1 | 10/2002 | Brundidge | | |
| 2010/0138979 | A1 * | 6/2010 | Thompson | A45D 20/12 | 2/174 |
| 2016/0353824 | A1 * | 12/2016 | Smith | A42B 1/208 | |
| 2018/0213918 | A1 | 8/2018 | Graves | | |

* cited by examiner

APPARATUS AND METHOD FOR PROTECTING COSMETIC ENHANCEMENTS

CROSS-REFERENCE TO RELATED APPLICATION(S)

This application is a national stage application, filed under 35 U.S.C. § 371, of International Patent Application No. PCT/US2019/055550, filed on Oct. 10, 2019, which claims the benefit of U.S. Provisional Patent Application No. 62/769,248, filed on Nov. 19, 2018, each of which is incorporated by reference herein in its entirety.

BACKGROUND OF THE INVENTION

What was once a trend, false eyelashes, eyelash extensions and enhanced eyebrows have now turned into one of the biggest booms and everyday accessories in the cosmetic industry. False eyelashes or eyelash extensions are used to lengthen, add depth or fullness, or curl natural eyelashes. With more than 300 different types of false eyelashes in the marketplace today, a consumer can choose from an assortment of styles, materials, lengths and cost. The market for false eyelashes is expected to surpass more than $1.5B in the next 5 years. Accordingly, use of false eyelashes or eyelash extensions and enhanced eyebrows is widespread.

Typically, the false eyelash or eyelash extension application processes may take up to two hours and cost between $50-400. Similarly, microblading is an eyebrow enhancing approach, comprises semi-permanent make-up or tattooing where pigment is added to the eyebrow area to create a fullness and defined shape. Typically, microblading will last one to three years depending on skin type and skincare routine and is also very costly to maintain. A consumer of false eyelashes, eyelash extensions, or eyebrow enhancements may commit both time and financial resources to these cosmetic industry offerings. Accordingly, the consumer may take steps to protect these cosmetic enhancements throughout the enhancements' use.

SUMMARY OF THE PRESENT INVENTION

Various exemplary embodiments of the present disclosure may demonstrate one or more of the invention features. Other features and advantages of this invention will become apparent from the following detailed description of the presently preferred embodiments of the invention, taken in conjunction with the accompanying drawings.

In accordance with an exemplary embodiment, a protective apparatus for protecting cosmetic enhancements may include a headband comprising a stretchable material, a left ear piece in communication with the headband on a left side and a right ear piece in communication with the headband on a right side. The protective apparatus may further include a deflecting element in communication with the headband. The protective apparatus may engage the left ear piece and the right ear piece to adjust the headband. The protective apparatus may further include a water impervious seal formed between the adjusted headband and a wearer's forehead.

In accordance with another exemplary embodiment, a protective apparatus for protecting cosmetic enhancements may include a stretchable material, a left ear piece in communication with the stretchable material on a left side and a right ear piece in communication with the stretchable material on a right side. Engaging the left ear piece and right ear piece of the protective apparatus may form a headband portion in communication with a deflecting element portion from the stretchable material. Engaging the left ear piece and right ear piece may also adjust the headband portion. The protective apparatus may further include a water impervious seal formed between the adjusted headband portion and a wearer's forehead.

In accordance with a further exemplary embodiment, a method for protecting cosmetic enhancements may include engaging a left ear piece in communication with a stretchable band on a left side and engaging a right ear piece in communication with the stretchable band on a right side. The method may further include adjusting the stretchable band and creating a water impervious seal between the adjusted band a wearer's forehead. The method may further include deflecting liquid from the wearer's face using a deflecting element in communication with the adjusted band.

It is to be understood that both the foregoing general description and the following detailed description are exemplary and explanatory only and are not restrictive of the present disclosure or claims.

BRIEF DESCRIPTION OF THE DRAWINGS

The drawings referenced herein are incorporated in and form part of the specification.

The drawings illustrate one or more exemplary embodiments of the present disclosure and together with the description serve to explain various principles and operations. Implications that the drawings illustrate all embodiments of the invention are not to be made.

DETAILED DESCRIPTION OF THE INVENTION

Figure 1:
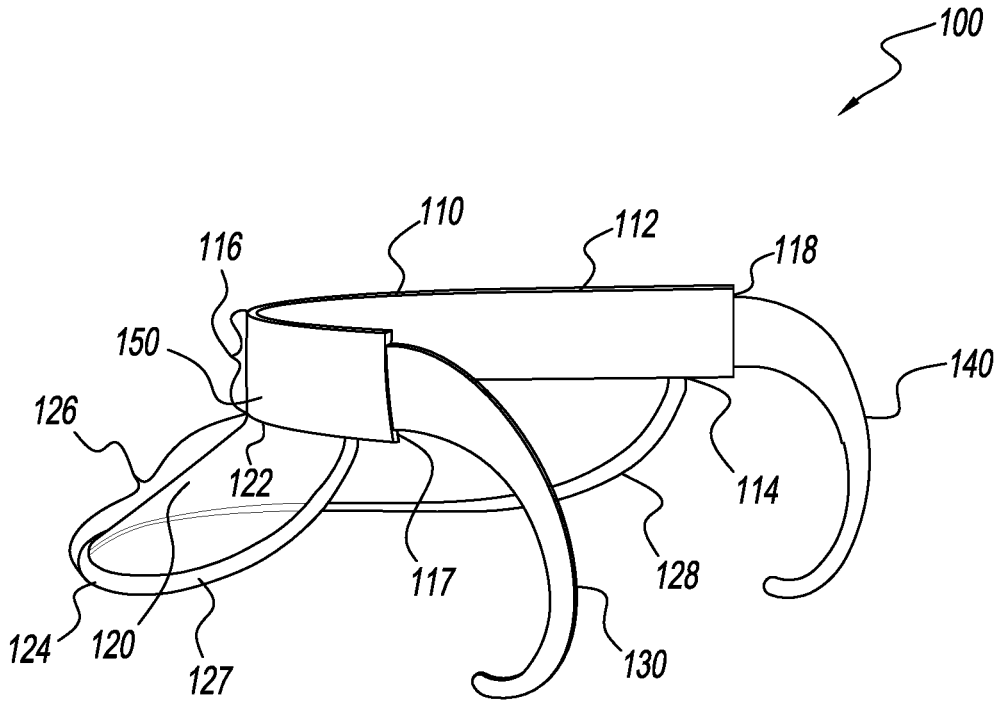
FIG. 1 illustrates a side view of a protective apparatus.

Reference will now be made in detail to various exemplary embodiments of the present disclosure, examples of which are illustrated in the accompanying drawings.

It will be readily understood that the components of the present invention, as generally described and illustrated in the figures herein, may be arranged and designed in a wide variety of different configurations. Thus, the following detailed description of the embodiments of an apparatus for protecting cosmetic enhancements, such as false eyelashes, eyelash extensions, or enhanced eyebrows, of the present invention, as presented in the figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearance of the phrases "a select embodiment," "in one embodiment," or "in an embodiment" in various places throughout this specification are not necessarily referring to the same embodiment.

Features, structure, or characteristics described herein may be combined in any suitable manner in one or more embodiments. One skilled in the relevant art will recognize, however, that the invention may be practiced without one or more of the specific details, or with other methods, components, or materials. In other instances, well-known materials or processes are not shown or described in detail to avoid obscuring aspects of the invention. The following description, which shows by way of illustration specific embodiments in which the invention may be practiced, is intended only by way of example. That is, the following description simply illustrates certain selected embodiments of an apparatus for protecting cosmetic enhancements that are consistent with the invention as claimed herein. It is to be understood that other embodiments may be utilized because structural and process changes may be made without departing from the scope of the present invention.

Typically, false eyelash or eyelash extension application processes may take hours and cost hundreds of dollars. Microblading, an eyebrow enhancing approach, may also take significant time and money. Microblading may comprise semi-permanent make-up or tattooing where pigment is added to the eyebrow area to create a fullness and defined shape. Accordingly, cosmetic enhancements, such as false eyelash, eyelash extensions, or enhanced eyebrows, may take time and money to apply and a consumer may expect the cosmetic enhancement applications to last.

Consumers with these applied cosmetic enhancements may be warned against getting the enhancements wet. Water may deteriorate the glue used to apply false eyelashes, or may deteriorate the false eyelashes, themselves. Water may also deteriorate ink used in, for example, microblading eyebrow applications. Additionally, water may weigh down eyelash extensions or false eyelashes and may create unwanted residue on the cosmetic enhancements. Accordingly, cosmetic enhancements may deteriorate over time with regular contact to water.

If kept dry and clean, cosmetic enhancements, such as false eyelashes, extended eyelashes, or enhanced eyebrows, may last longer and require less maintenance. Further, these types of cosmetic enhancements, if kept dry, may avoid infection and breakage. In the long run, maintaining dry cosmetic enhancements may promote longer aesthetic function and save consumer money. Accordingly, keeping cosmetic enhancements dry may promote longer cosmetic enhancement life and save consumer money.

In an effort to preserve longer function and aesthetic of cosmetic enhancements, such as applied false eyelashes, eyelash extensions or enhanced eyebrows, a consumer may take steps to keep the cosmetic enhancements dry. A consumer may take these steps in certain situations, such as during a shower or when the consumer's face may be otherwise exposed to water. For example, an exemplary embodiment of the present invention may comprise a wearable apparatus, or apparatus otherwise in communication with a person's face, and the apparatus may protect cosmetic enhancements from water contact during the shower. In an embodiment, for example, a protective apparatus may perform umbrella-like functions when exposed to water. In a most general sense, umbrellas may protect a person when exposed to inclement weather, such as minimizing contact with rain water. The shape of an umbrella may support additional functions, such as moving or deflecting rain water away from the person. Water does not remain standing on the umbrella. Similarly, an exemplary embodiment of the present invention may perform at least one of these two functions: (1) minimizing contact between cosmetic enhancements and water; and (2) deflecting water from near the cosmetic enhancements. Accordingly, an apparatus in accordance with the present invention may perform umbrella-like functions to protect cosmetic enhancements when exposed to water.

As described herein above, water may cause damage to cosmetic enhancements, such as false eyelashes, eyelash extensions, or enhanced eyebrows. In an exemplary embodiment, a protective apparatus of the present invention may minimize contact between the cosmetic enhancements and, for example, overhead liquid, such as shower water, and may deflect the water away from a wearer's face. In an embodiment, for example, a protective apparatus of the present invention may comprise a headband, a visor, a left ear piece or arm, and a right ear piece or arm. Any one of these elements, any combination of these elements, or all of these elements combined may function to minimize contact between cosmetic enhancements and, for example, water and may function to deflect water away from a wearer's face. In an embodiment, for example, materials, shapes, and respective positioning of these elements may function to minimize contact between cosmetic enhancements and water and may function to deflect water away from a wearer's face. In an embodiment, for example, a combination of these elements may function and adjust to form a water impervious seal between a protective apparatus of the present invention and a wearer's face. In doing so, for example, the protective apparatus of the present invention may, among other things, minimize contact between cosmetic enhancements and water. Accordingly, elements of a protective apparatus may minimize contact between overhead liquid and a wearer's face and may deflect the liquid from a wearer's face.

In an alternative embodiment, for example, a protective apparatus of the present invention may comprise a single-piece visor, which may comprise both a headband portion and a visor portion, a left ear piece or arm, and a right ear piece or arm. In an embodiment, for example, a single-piece visor may comprise a shape such that adjusting and stretching the single-piece visor may form a headband portion and a deflecting element portion from the single-piece visor. In other words, in an embodiment, creating tension across a stretchable material of a single-piece visor may bend the single-piece visor and may form a headband portion and a deflecting element portion in communication with the headband portion. Accordingly, a headband portion and a deflecting element portion in communication with the headband portion may be formed by creating tension on a single-piece visor.

In an exemplary embodiment, a protective apparatus may create a water impervious seal with a wearer's face, such as at face skin above cosmetic enhancements or sides of the face. In an embodiment, the water impervious seal may minimize, for example, shower water seepage between the protective apparatus and the wearer's face. In an exemplary embodiment, the protective apparatus may create a water impervious seal at some position above a wearer's eyebrows and extending some horizontal length across at least the wearer's eyebrows. In an embodiment, for example, the protective apparatus may create a water impervious seal extending horizontally across a wearer's forehead and beyond the wearer's eyebrows. In an exemplary embodiment, a headband or headband portion may expand a width of a wearer's forehead, and the headband or headband portion may create a water impervious seal with the wearer's forehead. In an embodiment, for example, the headband or headband portion may create a water impervious seal based on its material, its shape, or its positioning relative to the wearer's face or relative to ear pieces. For example, in an embodiment, the headband or headband portion may be tapered. In another embodiment, for example, the headband or headband portion may comprise stretch materials, such as four-way stretch material. For example, in an embodiment, the headband or single-piece visor may comprise foam. In an embodiment, the protective apparatus may create a water impervious seal spanning from a point on left side of a wearer's face and across the wearer's face to a point on a right side of a wearer's face. For example, in an embodiment, the water impervious seal may span from an outer point of one ear to an outer point of a second ear. In doing so, the protective apparatus may provide protection against water seepage from ear to ear. Accordingly, a protective apparatus of the present invention may create a water impervious seal across at least some aspect of a wearer's face.

In an exemplary embodiment, a protective apparatus of the present invention may comprise an arm, or ear piece, on each side of a wearer's face; each arm may extend a distance from an outer point of an eyebrow to an ear and may communicate or attach to a side of a headband or single-piece visor. In an exemplary embodiment, as described above, a headband or single-piece visor may expand across a wearer's eyebrows. With that in mind, for example, a left arm may extend from an outer point on a left eyebrow to some position on a left ear and a right arm may extend from an outer point of a right eyebrow to some position on a right ear. In an embodiment, for example, the outer point on a left eyebrow may be proximate to the left eyebrow or may be proximate to the left ear. Similarly, in an exemplary embodiment, the outer point on the right eyebrow may be proximate to the right eyebrow or may be proximate to the right ear. Accordingly, a protective apparatus of the present invention may comprise a left ear piece and a right ear piece, both ear pieces in communication with a headband or a single-piece visor, and each ear piece may extend from some point on a wearer's face to some point on a wearer's ear.

In an exemplary embodiment, each arm, also referred herein as an ear piece, may form a shape to position the arm relative to an ear. Additionally, in an exemplary embodiment, each arm may function to create a water impervious seal. For example, the right arm may create a right seal between the protective apparatus and the right side of the face, and the left arm may create a left seal between the protective apparatus and the left side of the face. In an exemplary embodiment, the left arm and right arm structures may create a left seal and right seal, respectively, using friction, suction, compression forces, or any combination thereof. In another embodiment, the left arm and right arm structures, in conjunction with materials used for the arm structures and a headband or single-piece visor, may create a water impervious seal across a wearer's forehead. In an embodiment, the water impervious seal may extend from a point on the left arm structure to a point on the right arm structure. In an embodiment, for example, each ear piece may, using its position behind each ear, pull a headband or single-piece visor tight against a wearer's face. In doing so, in an embodiment, for example, the ear pieces help the headband or single-piece visor create a secure water impervious seal with the wearer. In an exemplary embodiment, the left arm and right arm structures may comprise hinges. In an exemplary embodiment, the right seal and the left seal may support creating a water impervious seal between the protective apparatus and the wearer's forehead, or face, above the right and left eyebrows. In an embodiment, for example, as described above, each arm in combination with a headband may create a water impervious seal with some portion of a wearer's face. Accordingly, a protective apparatus of the present invention may create a water impervious seal, and the water impervious seal may extend across a wearer's forehead and sides of a wearer's face.

In an embodiment, as described above, a protective apparatus may comprise a single-piece visor. The single-piece visor may bend to form a headband portion and a deflecting element portion, as described above. A protective apparatus of the present invention may, as described above, engage at least one of a right ear piece and left ear piece, or right arm structure and left arm structure, and the single-piece visor may be secured to or around the wearer's right ear and left ear, respectively. In an embodiment, a process of securing the left ear piece and the right ear piece may create tension across a headband portion of the single-piece visor, and may, as a result, conform a headband portion to a wearer's face. In doing so, in an embodiment, for example, the ear pieces may help the headband portion create a secure water impervious seal with the wearer. Accordingly, a protective apparatus of the present invention may comprise a headband portion that may create a water impervious seal with a wearer's skin.

In an exemplary embodiment, the deflecting element portion of the single-piece visor may be shaped to capture or deflect, for example, overhead shower water, and may move the water away from a wearer's face or cosmetic enhancements. In an exemplary embodiment, the deflecting element portion may comprise a somewhat or substantially curved shape. Accordingly, a protective apparatus of the present invention may comprise a single-piece visor that, when stretched, may water impervious seal to a wearer's face while, at the same time, forming a deflecting element.

In another exemplary embodiment, the left arm and right arm structures may comprise elastic material, or a material with elasticity properties, which may tighten a headband or a single-piece visor across, at least, a portion of a forehead. The tightening may adjust the headband or single-piece visor and strengthen a water impervious seal between the portion of the forehead and the apparatus. The left arm elastic material may tighten around a left ear and a right arm elastic material may tighten around a right ear. Similarly, these tightening actions may tighten a water impervious seal across a wearer's forehead. In an embodiment, these tightening actions may tighten a water impervious seal spanning a distance from near a left ear, across a forehead, to near a right ear of a wearer of a protective apparatus. In an exemplary embodiment, any seal created between the protective apparatus and the wearer's face may support slip-proof apparatus functions. Accordingly, a protective apparatus in accordance with the present invention may create a water impervious seal between a protective apparatus and a wearer's face.

In an exemplary embodiment, the left arm and the right arm may wrap around the left ear and the right ear, respectively. In an embodiment, the left arm and the right arm in communication with a headband or a headband portion of a single-piece visor may adjust the headband or single-piece visor and wrap completely around the left ear and the right ear, respectively. For example, in an embodiment, the left ear piece may comprise a material looped around the left ear and the right ear piece may comprise material looped around the right ear. In an embodiment, the material may comprise, for example, elastic tubing. In an exemplary embodiment, the elastic tubing ear piece may become engaged or tense when positioned around each ear. For example, in an embodiment, the engaged ear piece may pull on a headband or headband portion of a single-piece visor of a protective apparatus of the present invention and stretch and adjust the headband or single-piece visor. As a result, for example, the ear pieces may create a tension on a headband stretchable material or headband portion stretchable material when looped around a wearer's ears. The created tension, for example, may create a water impervious seal between the stretchable and adjustable material and a wearer's face. Accordingly, a protective apparatus of the present invention may comprise looped ear pieces.

In an embodiment, the elastic tubing size for an ear piece may be adjusted to support creating the water impervious seal between the headband or headband portion of a single-piece visor and a wearer's face. In an embodiment, the left arm and right arm structures may comprise, for example, elastic tubing in communication with a clip mechanism, wherein the clip mechanism may attach and adjust a size of the elastic tubing to the headband or headband portion of a single-piece visor. The adjusted tubing adjusts the headband or single-piece visor to a wearer's face. Accordingly, a protective apparatus may comprise a left ear piece and a right ear piece in communication with a headband or single-piece visor and may adjust to create tension on a headband or a headband portion of a single-piece visor.

As described herein above, in an exemplary embodiment, a protective apparatus of the present invention may deflect water, such as shower water, from nearby cosmetic enhancements. In an embodiment, for example, a protective apparatus in accordance with the present invention may comprise a water deflection element, such as a visor. In an embodiment, for example, the visor may comprise a curved shape, a rim, a drainage channel, or any combination thereof, which may support moving water. In an exemplary embodiment, the water deflection element, such as a rim, may be long and wide. In an embodiment, for example, the visor may extend across a wearer's forehead, and may further extend to a point near or above a right ear and to a point near or above a left ear. The visor may emulate overhang functions in a front of a wearer's face, on a left side of the wearer's face, and on a right side of the wearer's face. The overhang functions may distribute shower water, or other water originating above a wearer's face, away from the wearer's cosmetic enhancements. With help from a right ear piece and left ear piece, or right arm structure and left arm structure, as described above, the visor may be secured to or around the wearer's right ear and left ear. The deflection element may capture, for example, shower water, and may move the water away from a wearer's cosmetic enhancements. Accordingly, a protective apparatus in accordance with the present invention may deflect water away from a wearer's face.

In another exemplary embodiment of the present invention, a protective apparatus may comprise materials that may minimize potential contact between cosmetic enhancements and, for example, shower water. In an exemplary embodiment, a protective apparatus may comprise water proof materials, which deflect communicating water, such as shower water, away from the protective apparatus. Similarly, a protective apparatus may comprise sweat-proof materials, which may deflect communicating sweat, or other liquids, away from the protective apparatus. For example, in an embodiment, elements of a protective apparatus may comprise foam. Accordingly, a protective apparatus in accordance with the present invention may comprise materials that deflect liquids.

A consumer interested in minimizing damage to cosmetic enhancements may also have an interest in minimizing damage to a protective apparatus of the present invention. For example, in an embodiment, a protective apparatus in accordance with the present invention may comprise mold resistant materials. In another exemplary embodiment, a protective apparatus may comprise steam or fog resistant materials. Accordingly, a protective apparatus in accordance with the present invention may comprise materials for ease of use and longevity.

In another exemplary embodiment, a protective apparatus of the present invention may adjust to different face shapes and sizes. Further, in an embodiment, the protective apparatus may comprise durable, portable, or reusable materials and structure. For example, in an embodiment, a protective apparatus may comprise flexible materials. Accordingly, a protective apparatus in accordance with the present invention may comprise flexible materials.

An apparatus for protecting cosmetic enhancements may comprise a visor-like structure. FIG. 1. Illustrates a side view of a protective apparatus (100) in accordance with the present invention. In an exemplary embodiment, a protective apparatus (100) may comprise a headband (110), a visor (120), a left ear piece (130), and a right ear piece (140). The headband (110) may comprise a top (112) and a bottom (114). In an exemplary embodiment, the headband (110) may comprise a uniform band across at least a wearer's forehead or face. In other words, a width (116) between a top (112) and a bottom (114) of the headband (110) may be uniform from a left side (117) to a right side (118). Accordingly, a protective apparatus in accordance with the present invention may comprise a headband.

As described herein above, in an exemplary embodiment, a protective apparatus (100) may comprise a visor (120). In an embodiment, for example, the visor (120) may comprise a top (122) and a bottom (124). A width (126) of the visor (120) may comprise a distance between the top (122) and the bottom (124) of the visor (120). The width (126) may be uniform from a left side (127) to a right side (128) of the visor (120). In an exemplary embodiment, a left side (127) of a visor (120) and a right side (128) of the visor (120) may extend to, or at least communicate with, a left arm (130) and a right arm (140), respectively. Accordingly, a visor element on a protective apparatus in accordance with the present invention may deflect water away from a wearer's cosmetic enhancements, and the deflection may occur from a right side of a wearer's face, across a wearer's forehead, to a left side of wearer's face.

In an exemplary embodiment, the visor (120) may comprise a tapered shape. In other words, a width (126) at a side, either a left side (127) or a right side (128), may be less than another width (126) of the visor (120). The bottom (114) of the headband (110) may communicate with the top (122) of the visor (120). The headband (110) and the visor (120) communicate at a seam (150). Accordingly, a protective apparatus in accordance with the present invention may comprise a visor.

As described herein above, in an exemplary embodiment, a protective apparatus (100) may comprise a left ear piece (130), and a right ear piece (140). A left ear piece (130) may communicate with a headband (110) at a left side (117) of the headband (110). Similarly, in an exemplary embodiment, a right ear piece (140) may communicate with the headband (110) at a right side (118) of the headband (110). In an exemplary embodiment, the left ear piece (130) and the right ear piece (140) may each form a hook-like shape to conform to a wearer's left ear and right ear, respectively. The shape of the ear piece of the present invention may support proper positioning of a protective apparatus (100) on a wearer. Additionally, in an exemplary embodiment, the shape of the ear piece may enhance a water impervious seal created between the protective apparatus (100) and the wearer's face. In an exemplary embodiment, a hook-like shape may allow for ease of wear and support a water impervious seal between a headband (110) and a wearer's forehead or face. Accordingly, a protective apparatus in accordance with the present invention may have shaped ear pieces.

Figure 2:
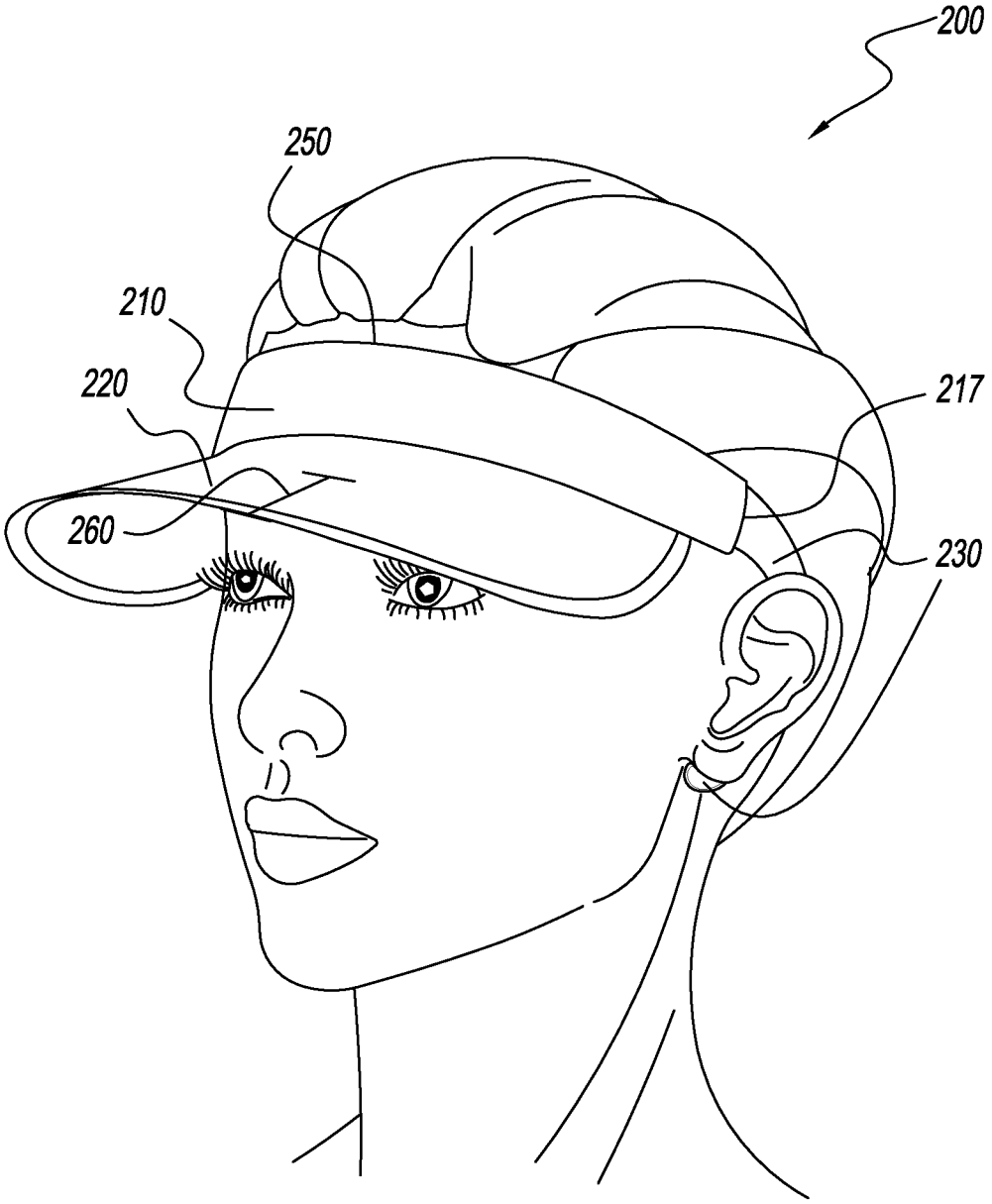
FIG. 2 illustrates a perspective view of a protective apparatus in use.

FIG. 2. Illustrates a side view of a protective apparatus in use (200) on a wearer in accordance with the present invention. In an exemplary embodiment, a protective apparatus (200) may comprise a headband (210), a visor (220), a left ear piece (230), and a right ear piece (not shown). As shown on a wearer, the headband (210) may directly communicate with a wearer's face at a seal (250). In an exemplary embodiment, the seal (250) may extend a total distance from a left side (217) of a headband (210) to a right side (not shown) of a headband (210). In an alternative embodiment, the seal (250) may extend a lesser or greater than total distance from the left side (217) of the headband (210) to the right side (not shown) of the headband (210). In an alternative embodiment, for example, a seal may extend from a left ear piece (230) to a right ear piece (not shown), or may extend from a point proximate to a left ear piece (230) to a point proximate to a right ear piece (not shown). The visor (220) may extend a distance (260) beyond a length of a cosmetic enhancement, such as a false eyelash, eyelash extension, or enhanced eyebrow. A left ear piece (230) may communicate completely or in points with a left ear of a wearer. Similarly, a right ear piece (not shown) may communicate completely or in points with a right ear of a wearer. Accordingly, a protective apparatus in accordance with the present invention may communicate directly with a wearer's face or forehead.

Figure 3:
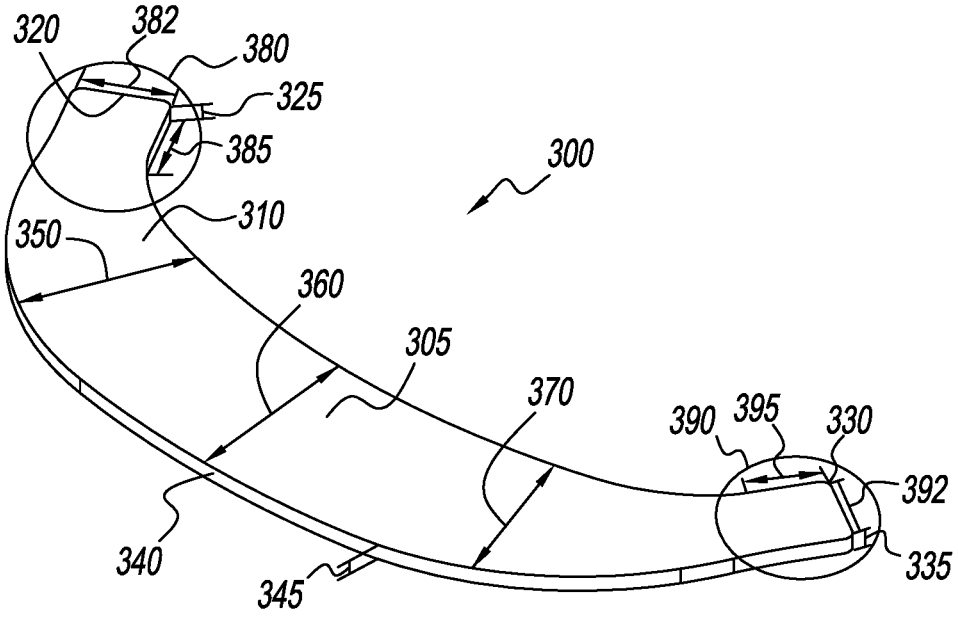
FIG. 3 illustrates a perspective view of a protective apparatus.

FIG. 3. Illustrates a perspective view of a protective apparatus (300) in accordance with the present invention. In an exemplary embodiment, a protective apparatus (300) of the present invention may comprise a single-piece visor (305). In an exemplary embodiment, the single-piece visor (305) may comprise a top side (310), a bottom side (not shown), a left edge (320), a right edge (330), a front edge (340), and a back edge (not shown). Although a single piece of material, the single-piece visor (305) may comprise different widths. With respect to FIG. 1 and FIG. 2 described above, a visor may similarly comprise different widths, as described herein. For example, single-piece visor may comprise a first width (350), a second width (360), and a third width (370). In an exemplary embodiment, the second width (360) is greater than each of the first width (350) and the third width (370). As a result, in an exemplary embodiment, a single-piece visor (305), or a visor described in FIGS. 1 and 2, may form a curved shape. Accordingly, a protective apparatus of the present invention may comprise a curved shape.

In an embodiment, for example, a single-piece visor (305) may also comprise a left side element (380) and a right side element (390). The left side element (380) and the right side element (390) may communicate with wearer's face on a left side and right side, respectively. In an embodiment, the left side element (380) may comprise a left width (382) and a left length (385), and the right side element (390) may comprise a right width (392) and a right length (395). The left width (382), left length (385), right width (392), and right length (395) may comprise dimensions for comfort, size, tension, or any combination thereof. Other criteria may be considered in sizing the left size element (380) and right side element (390), and are considered herein. With respect to FIG. 1 and FIG. 2 described above, a headband may similarly comprise a left side element and a right side element, as described herein. Accordingly, a protective apparatus of the present invention may comprise a left side element and a right side element to conform the protective apparatus to sides of a wearer's face.

As described herein above, in an exemplary embodiment, a protective apparatus (300) of the present invention may comprise a single-piece visor (305), and the single-piece apparatus (305) may comprise a front edge (340) and a back edge (not shown). In an exemplary embodiment, the front edge (340) may comprise a front edge thickness (345) and the back edge (not shown) may comprise a back edge thickness (not shown). In an exemplary embodiment, the front edge thickness may be substantially similar to the back thickness, with respect to size. In an alternative embodiment, the front thickness may be somewhat similar or not similar, such as smaller, relative to the back thickness. In an embodiment, for example, a thickness (325) of a left edge (320) or a thickness (335) of a right edge (330) may be substantially similar to the front edge thickness (345) with respect to size. In an alternative embodiment, the thickness (325) of a left edge (320) or a thickness (335) of a right edge (330) may be somewhat similar or not similar, such as smaller, relative to the front edge thickness (345). Each of a thickness (325) of a left edge (320), a thickness (325) of a right edge (335), a front edge thickness (345), or a back edge thickness (not shown) may be determined based on material properties of the single-piece visor (305), user comfort, single-piece visor dimensions, or any combinations thereof. These thickness considerations are not meant to be limiting. Additional considerations for single-piece visor material thickness dimensions are considered. With respect to FIG. 1 and FIG. 2 described above, a headband and a visor may similarly comprise different thicknesses, as described herein. Accordingly, a protective apparatus in accordance with the present invention may stretch and conform to a user's face in view of thickness dimensions.

Figure 4:
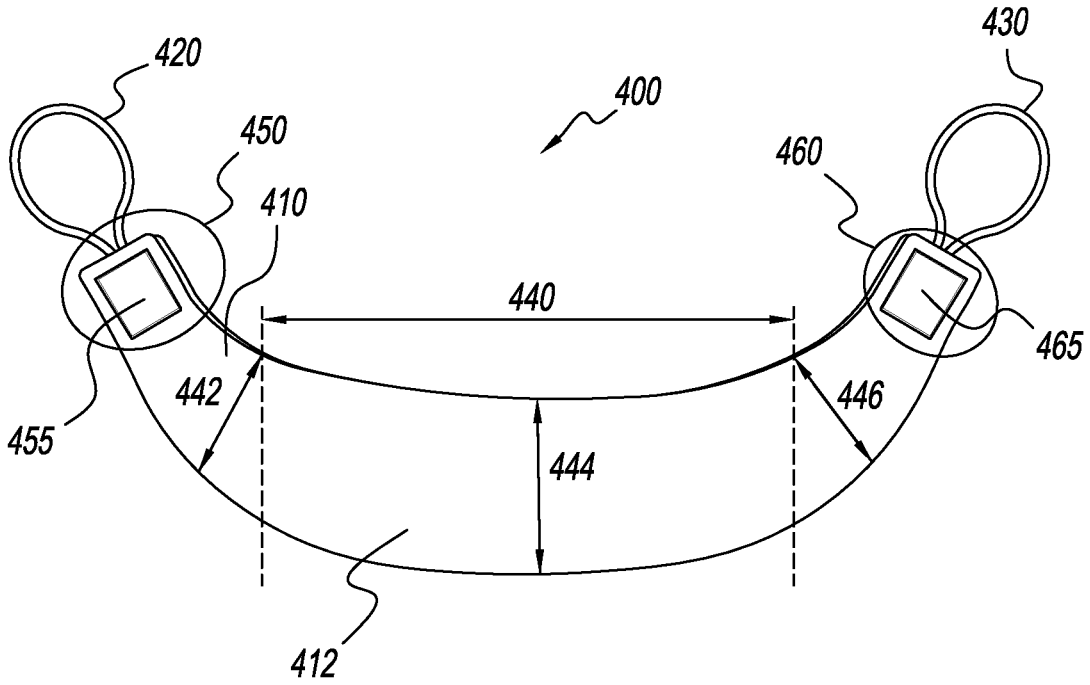
FIG. 4 illustrates a top view of a protective apparatus.

FIG. 4 illustrates a top view of a protective apparatus (400) in accordance with the present invention. In an exemplary embodiment, a protective apparatus (400) may comprise a single-piece visor (410), a left ear piece (420), and a right ear piece (430). The single-piece visor (410) may comprise atop side (412) and a bottom side (not shown). In an embodiment, a protective apparatus (400) of the present invention may comprise a middle section (440), a left side element (450), and a right side element (460). As described above with respect to FIG. 3, at least a middle section (440) may form a shape. In an exemplary embodiment, a first width (442) and a third width (446) are smaller than a second width (444). As a result, the middle section (440) may form a curved shape. In an embodiment, a left side element (450) may comprise a left side connection mechanism (455), which may connect a left ear piece (420) to the single-piece visor (410). In an embodiment, a right side element (460) may comprise a right side connection mechanism (465), which may connect a right ear piece (430) to the single-piece visor (410). Accordingly, a protective apparatus of the present invention may comprise a single-piece visor and ear pieces in communication with the single-piece visor.

In an exemplary embodiment, the left ear piece (420) and the right ear piece (430) may each form a loop-like shape to conform to a wearer's left ear and right ear, respectively. The shape of the ear piece of the present invention may support proper positioning of a protective apparatus (400) on a wearer. For example, in an embodiment, a loop-like shape may allow for ease of wear and support forming a water impervious seal between a single-piece visor (410) and a wearer's forehead or face. Accordingly, a protective apparatus in accordance with the present invention may have shaped ear pieces.

Figure 5:
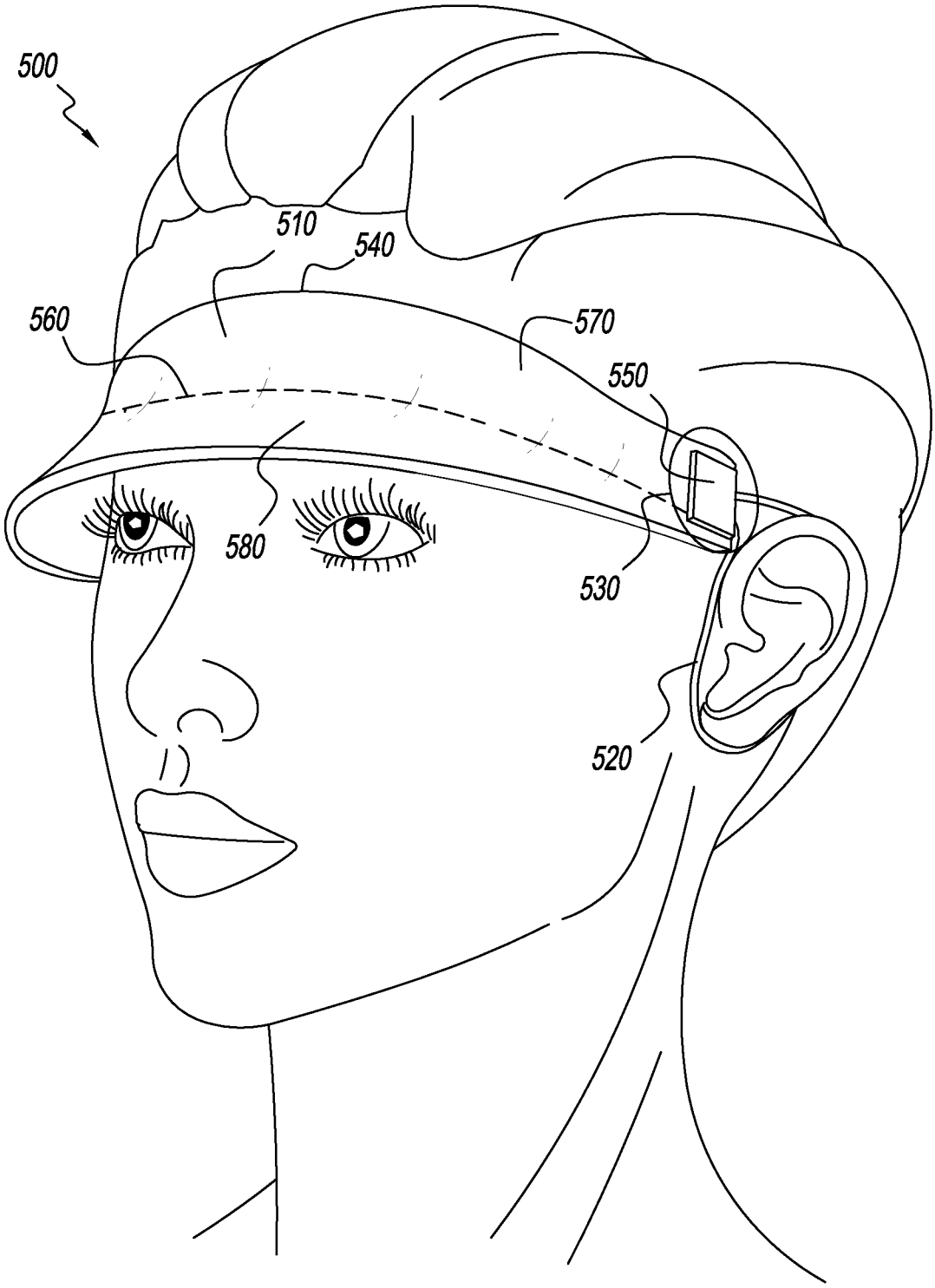
FIG. 5 illustrates a perspective view of a protective apparatus in use.

FIG. 5 illustrates a perspective view of a protective apparatus (500) in use on a wearer in accordance with the present invention. In an exemplary embodiment, a protective apparatus (500) may comprise a single-piece visor (510), a left ear piece (not shown), a right ear piece (520), a left side element (not shown), and a right side element (530). As shown on a wearer, the single-piece visor (510) may communicate with a wearer's face along a surface, and the communication may create a sealed surface (540) between the wearer's skin and the protective apparatus (500). In an exemplary embodiment, the sealed surface (540) may extend a total distance from a left side element (not shown) of the single-piece visor (510) to a right side element (530) of the single-piece visor (510). In an alternative embodiment, the sealed surface (540) may extend a lesser or greater than total distance from the left side element (not shown) of the single-piece visor (510) to the right side element (530) of the single-piece visor (510). In an alternative embodiment, for example, a sealed surface (540) may extend from a left ear piece (not shown) to a right ear piece (520), or may extend from a point proximate to a left ear piece (not shown) to a point proximate to a right ear piece (520). For example, in an embodiment, the single-piece visor (510) may create a sealed surface (540) that may extend a length of a cosmetic enhancements, such as a false eyelash, eyelash extension, or enhanced eyebrow, or further than the cosmetic enhancements, such as to sides of a wearer's face. Accordingly, a protective apparatus of the present invention may create a water impervious sealed surface that may extend a length of cosmetic enhancements or may extend from a left ear to a right ear, or any length desired.

A left ear piece (not shown) may communicate completely or in points with a left ear of a wearer. Similarly, a right ear piece (520) may communicate completely or in points with a right ear of a wearer. For example, in an embodiment, a left ear piece (not shown) or a right ear piece (520) may each form a loop, and each loop may communicate with an ear. In an embodiment, each loop may communicate with the single-piece visor (510) at a connection mechanism. For example, in an embodiment, the left ear piece (not shown) may communicate with the single-piece visor (510) at a left side element (not shown) via a left connection unit (not shown). In an embodiment, a right ear piece (520) may similarly communicate with the single-piece visor (510) at a right side element (530) via a right connection unit (550). In an exemplary embodiment, each connection unit may allow for personalization of the ear pieces. In other words, in an embodiment, the left connection unit (not shown) may allow for an adjustment of the left ear piece (not shown) to stretch the single-piece visor (510) to create a water impervious seal at the sealed surface (540). In an embodiment, the right connection unit (550) may similarly allow for an adjustment of the right ear piece (520) to stretch the single-piece visor (510) to create a water impervious seal at the sealed surface (540). Accordingly, a protective apparatus of the present invention may comprise elements that may adjust elements of ear pieces.

In an exemplary embodiment, a protective apparatus (500) of the present invention may conform to a wearer's face, and, in doing so, may create a sealed surface (540). In an exemplary embodiment, the conforming may comprise stretching a single-piece visor (510) across a wearer's face by a left ear piece (not shown) and a right ear piece (520) pulling on the single-piece visor (510) material. In an exemplary embodiment and based on a shape of the single-piece visor (510), a process of stretching the single-piece visor (510) may create a bend (560) in the single-piece visor (510). In an embodiment, the bend (560) forms the single-piece visor (510) into two sections: a headband portion (570), which may form a sealed surface (540), and a deflecting element portion (580), which may direct shower water or other overhead fluid away from a wearer's cosmetic enhancements. In other words, in an exemplary embodiment of a protective apparatus of the present invention, engaging ear pieces may stretch a single-piece visor and form a bend in the single-piece visor. Accordingly, a protective apparatus of the present invention may comprise a single-piece visor, and the single-piece visor may bend to form a headband portion and a deflecting element portion.

Figure 6:
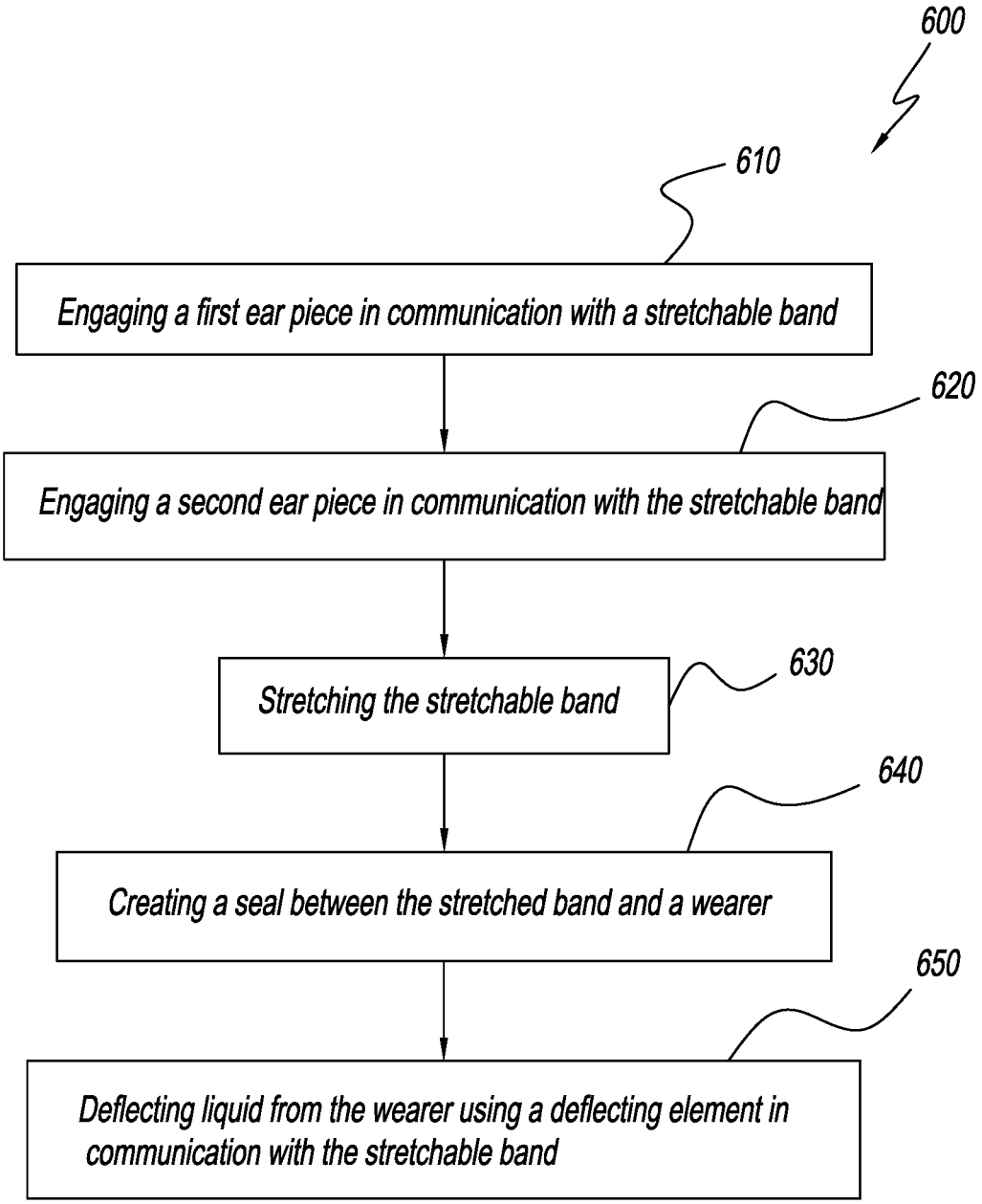
FIG. 6 illustrates a flow diagram showing protecting cosmetic enhancements.

FIG. 6 illustrates a a flow diagram showing protecting cosmetic enhancements in accordance with the present invention (600). In an exemplary embodiment, protecting cosmetic enhancements (600) may comprise engaging a first ear piece in communication with a stretchable band on a first side of the band (610) and engaging a second ear piece in communication with a stretchable band on a second side of the band (620). In an exemplary embodiment, a left ear piece may be engaged by positioning the left ear piece on a wearer's left ear. Similarly, in an exemplary embodiment, a right ear piece may be engaged by positioning the right ear piece on a wearer's right ear. In an embodiment, protecting cosmetic enhancements (600) may further comprise stretching the stretchable band (630). As described above, material used for a protective apparatus may comprise stretchable material, such as four-way stretchable material. In an exemplary embodiment, engaging the left ear piece and the right ear piece may create tension across the stretchable band by, in essence, adjusting and pulling the stretchable band across a wearer's forehead, and the adjusting and pulling arises from engaging a protective apparatus of the present invention on a wearer's left ear and from a wearer's right ear. In an exemplary embodiment, protecting cosmetic enhancements (600) may further comprise creating a seal between the stretched stretchable band and a wearer (640). For example, in an embodiment, a method of the present invention may create a water impervious seal between a protective apparatus of the present invention and a wearer's skin above cosmetic enhancements and on sides of a wearer's face. In an exemplary embodiment, protecting cosmetic enhancements (600) may further comprise deflecting liquid from the wearer using a deflecting element in communication with the stretchable band (650). Accordingly, protecting cosmetic enhancements may comprise creating a water impervious seal on a wearer's skin and deflecting liquid from a wearer via a protective apparatus.

As described above with respect to FIGS. 1-5, a deflecting element may be a pre-formed element in communication with a headband. In an alternative embodiment, a method of the present invention may comprise forming a headband portion and a deflecting element portion by creating tension on a single-piece visor. As described above, a method of the present invention may comprise creating tension on a single-piece visor by engaging the left and right ear pieces. A method of the present invention may further comprise forming the headband portion and the deflecting element portion by bending the tension-riddled single-piece visor. Accordingly, protecting cosmetic enhancements in accordance with the present invention may comprise creating a water impervious seal on a wearer's skin and deflecting liquid from the wearer using a protective apparatus comprising a single-piece visor.

It is to be understood that the various embodiments shown and described herein are to be taken as exemplary. Elements and materials, and arrangements of those elements and materials, may be substituted for those illustrated and described herein, parts may be reversed, and certain features of the present disclosure may be utilized independently, as would be apparent to one skilled in the art after having the benefit of the description herein. Changes may be made in the elements described herein without departing from the spirit and scope of the present disclosure and following claims, including their equivalents.

It is to be understood that the particular embodiments set forth herein are non-limiting, and modifications to structure, dimensions, materials, and methodologies may be made without departing from the scope of the present disclosure.

It is to be further understood that this description's terminology is not intended to limit the invention. For example, spatially relative terms, such as "front," "back," "top," "bottom," "side," and the like, may be used to describe one element's or feature's relationship to another element or feature as intended to connote the orientation of, for example, the protective apparatus as illustrated in the figures.

For the purposes of this specification and appended claims, unless otherwise indicated, all numbers expressing quantities, percentages or proportions, and other numerical values used in the specification and claims, are to be understood as being modified in all instance by the term "about" if they are not already. That is, unless indicated to the contrary, the numerical parameters set forth in the specification and claims are approximations that may vary depending on the desired properties sought to be obtained by the present disclosure.

What is claimed is:

1. A method, the method comprising:

providing a single-piece stretchable material, the single-piece stretchable material having a headband portion and a liquid-deflecting portion; the single-piece stretchable material having a first configuration in which the headband portion and the liquid-deflecting portion extend within the same plane;

providing an adjustable first ear piece and an adjustable second ear piece each attached to the single-piece stretchable material;

personalizing a size of the adjustable first ear piece;

personalizing a size of the adjustable second ear piece;

pulling the personalized adjustable first ear piece behind a wearer's first ear to create tension across the single-piece stretchable material;

pulling the personalized adjustable second ear piece behind a wearer's second ear to create tension across the single-piece stretchable material;

stretching the single-piece stretchable material across a wearer's forehead;

the pulling and stretching creating a water impervious seal between the headband portion and the wearer's forehead and forming a bend in the stretched single-piece stretchable material, such that the pulling and stretching causes the single-piece stretchable material to assume a second configuration in which the headband portion and the liquid-deflecting portion do not extend within the same plane; wherein the headband portion extends upwardly from the bend, and the liquid-deflecting portion extends downwardly from the bend and forwardly from the wearer's forehead;

and deflecting liquid forwardly from the wearer's forehead and downwardly from the bend along the liquid deflecting portion.

2. The method of claim 1, wherein at least one of the adjustable first ear piece and adjustable second ear piece includes an elastic tubing.

* * * * *